United States Patent [19]

Nozawa et al.

[11] 4,343,397

[45] Aug. 10, 1982

[54] COMPACT HAVING STAY-OPEN LID STRUCTURE

[75] Inventors: Takamitsu Nozawa; Takaharu Tazaki, both of Tokyo, Japan

[73] Assignee: Yoshino Kogyosho Co., Ltd., Tokyo, Japan

[21] Appl. No.: 215,496

[22] Filed: Dec. 11, 1980

Related U.S. Application Data

[62] Division of Ser. No. 142,710, Apr. 22, 1980, Pat. No. 4,291,818.

[30] Foreign Application Priority Data

May 18, 1979 [JP] Japan ..... 54-61116

[51] Int. Cl.[3] ..... A45C 11/00

[52] U.S. Cl. ..... 206/37; 220/335

[58] Field of Search ..... 220/335, DIG. 26, 339; 206/37 R; 16/150, 128 R

[56] References Cited

U.S. PATENT DOCUMENTS

| | | | |
|---|---|---|---|
| 2,829,765 | 4/1958 | Burger | 206/37 R |
| 4,132,306 | 1/1979 | Margolin | 206/37 |
| 4,158,902 | 6/1979 | Chernack | 220/335 X |

*Primary Examiner*—George T. Hall

*Attorney, Agent, or Firm*—Stevens, Davis, Miller & Mosher

[57] ABSTRACT

A lid made of a synthetic resin and swingable like a cover for a book to open or close the opening of a container. A leg or legs of desired length extending rearwardly from the rear end of a lid plate renders the lid plate capable of maintaining a desired open position, and moving automatically into its open and closed positions. Such capabilities of the lid plate depend on the force created by a flat surface carrying a hinge base to urge the free end of the leg upwardly, the elasticity of a hinge and the hinge base, and the distance defined between the hinge and the free end of the leg which has been moved. The lid is particularly suitable for a compact for a cosmetic, or the like.

3 Claims, 23 Drawing Figures

COMPACT HAVING STAY-OPEN LID STRUCTURE

This is a Division of application Ser. No. 142,710 filed Apr. 22, 1980, now U.S. Pat. No. 4,291,818.

This invention relates to a lid formed from a synthetic resin, and which is swingable like a cover for a book to open and close the opening.

Compact, casters and liquid containers are now often provided with a lid formed from a synthetic resin, and having a reduced thickness hinge portion, and a lid portion which is formed integrally with the hinge portion and swingable thereabout like a cover for a book.

Such a lid is useful for a wide range of applications, since it is very simple in construction as compared with a traditional hinge having a pin. It also works more accurately, and is easier to handle than a lid which is connected integrally with a container body or a lid base by an elongated elastic member.

Although a lid of the aforementioned type having a lid portion formed integrally with a reduced thickness hinge portion has a number of advantages as described above, various means have to be provided to render the lid portion capable of retaining its position, and the lid presents a lot of difficulty when connected to a container body or a lid base, since the resinous material from which the lid can be molded is limited substantially to polypropylene.

In addition to these disadvantages, the known lid structure has been accompanied by a serious drawback. That is, the lid is a great obstacle to the discharge of the container, as the elasticity of the hinge tends to bring the lid back into its closed position when it is opened.

It is, therefore, an object of this invention to provide a lid which is easy to mold and assemble with a container, and can be easily opened and closed.

It is another object of this invention to provide a lid which ensures the closure of a container.

It is a further object of this invention to make it possible for a lid for a container to stay at a desired angle relative to the container when opened.

This invention is, thus, characterized by the provision of a leg of desired length extending rearwardly from the rear edge of a lid plate. A flat surface on which a hinge base is disposed creates a thrust acting upwardly upon the free end of the leg. A hinge and the hinge base have an adequate degree of elasticity. The free end of the leg is adapted to be spaced an appropriate distance from the hinge. These factors are combined with one another to render the lid plate capable of maintaining a desired position when opened, and moving into its open or closed position automatically.

Other objects and advantages of the present invention will become apparent from the following description taken in conjunction with the accompanying drawings; in which.

Figure 1:
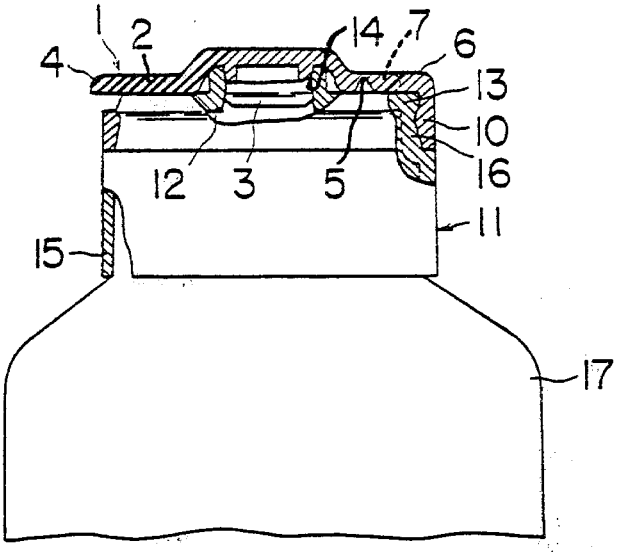
FIG. 1 is a view showing partly in section the basic structure if this invention in its closed position.

Referring to the drawings, a lid of this invention which is made of a synthetic resin comprises a lid base 11 threadedly connected, or fitted over a container body 17 by a cylindrical connector 15 in intimate contact therewith, and a lid body 1 disposed on the top wall 12 of the lid base 11 and adapted for swinging like a cover for a book to open and close an opening 14 provided in the top wall 12.

Figure 2:
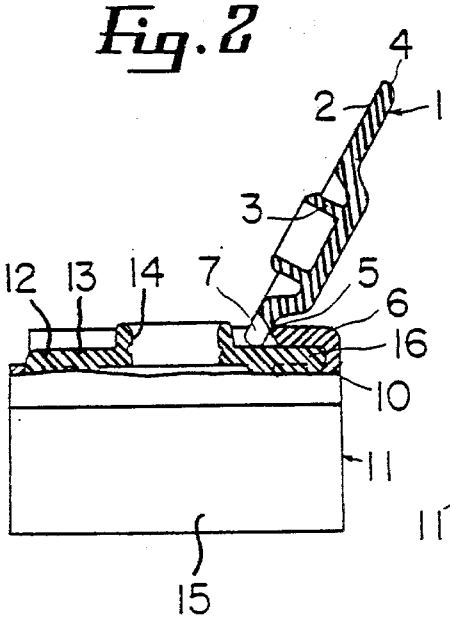
FIG. 2 shows the open position of the lid in FIG. 1.
Figure 3:
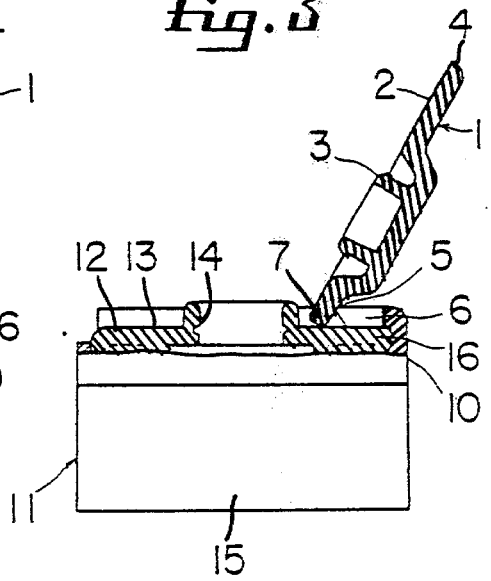
FIG. 3 is a view similar to FIG. 2, but showing a leg cut away along an irregular line.

As shown in FIGS. 1 to 3, the lid body 1 includes a generally flat lid plate 2, and a hinge base 6 extending from the rear edge of the lid plate 2, between which a notch or reduced thickness portion defining a hinge 5 is provided along a part of the rear edge of the lid plate 2. A connector 10 depends from the underside of the hinge base 6. A leg 7 having a desired length extends rearwardly from the remaining part of the rear edge of the lid plate 2 (i.e., in the embodiment shown, from the rear edge on either side of the hinge 5). The top wall 12 of the lid base 11 has an upper surface 13 which is flat at least in the rear half thereof facing the leg 7. The lid base 11 has a neck 16 facing the connector 10 on the lid body 1, and the connector 10 is rigidly secured about the neck 16.

The length of the leg 7 is very closely related to the height of the hinge 5 above the upper surface 13 of the lid base 11, and is at least greater than the distance between the hinge 5 and the upper surface 13.

When a finger is engaged with a lid 4 at the front edge of the lid plate 2 to rotate the lid plate 2 from its closed position shown in FIG. 1 to its open position, an integral assembly of the lid plate 2 and the leg 7 is rotated about the hinge 5, and the free end of the leg 7, of which the length is greater than the distance between the hinge 5 and the upper surface 13, is pressed against the upper surface 13, so that the hinge base 6 undergoes elastic deformation to permit upward displacement of the hinge 5.

The elastic deformation of the hinge plate 6 reaches its maximum degree when the lid plate 2 is substantially perpendicular to the upper surface 13, though depending somewhat on the shape of the free end of the leg 7.

With further rotation of the lid plate 2, the amount of elastic deformation of the hinge base 6 is reduced until it becomes zero when the lid plate 2 is rotated into its position shown in FIG. 2. The elasticity of the hinge 5 tending to rotate the lid plate 2 into its closed position, and the elasticity of the hinge base 6 tending to hinder such rotation of the lid plate 2 balance each other to maintain the lid plate 2 in its open position having an angle of opening determined by the length of the leg 7 and the distance between the hinge 5 and the upper surface 13.

After the lid plate 2 is rotated to the position substantially perpendicular to the upper surface 13, the elasticity of the hinge base 6 automatically forces the lid plate 2 into its open position shown in FIGS. 2 and 3, and maintains it in that position.

If it is desired to rotate the lid plate 2 from its open position shown in FIGS. 2 and 3 to its closed position, it is sufficient to push it with a force overcoming the elasticity of the hinge base 6. After the lid plate 2 is rotated back to a position substantially perpendicular to the upper surface 13, the elasticity of the hinge base 6 automatically forces the lid plate 2 into its closed position.

It will be obvious from the foregoing description of the essential construction and operation of the lid according to this invention that when the lid plate 2 closing the opening 14 is opened, it is maintained in the position which is determined by the length of the leg and the distance between the hinge 5 and the upper surface 13, but that no function of holding the lid plate 2 in its closed position can be derived from the mutual relationship among the hinge 5, hinge base 6 and leg 7.

In order to cope with this problem, the embodiment shown in FIGS. 1 to 3 includes a stopper 3 projecting from the underside of the lid plate 2, and adapted to fit closely in the opening 14 upon closure of the lid plate 2 in such a manner that it may not inadvertently be withdrawn.

While the aforementioned means does certainly have its own merit, the stopper 3 is required to make a relatively tight fit in the opening 14 in order not to be inadvertently withdrawn therefrom. Accordingly, a relatively strong force is required to open and close the lid.

Although the open position of the lid plate 2 is determined by the length of the leg 7 and the distance between the hinge 5 and the upper surface 13, excessive prolongation of the leg 7 as compared with the distance between the hinge 5 and the upper surface 13 heads to an unnecessary increase in the force required to open or close the lid plate 2. This means that the length of the leg 7 has its own limitation relative to the distance between the hinge 5 and the upper surface 13, thereby limiting the open position of the lid plate 2.

A further problem of the basic structure shown in FIGS. 1 to 3 is that the lid plate 2 always has an angle of opening which is greater than 90°, while a smaller angle, e.g. about 90°, is often sufficient, depending on the contents of the container 17.

Figure 4A:
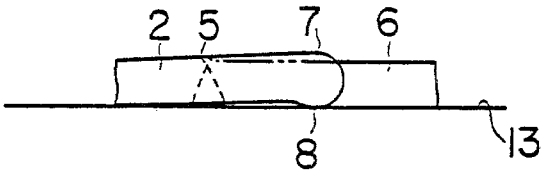
FIGS. 4A and 4B are fragmentary enlarged views schematically illustrating different forms of legs.

The aforementioned problems may be solved, for example, by forming the free end of the leg 7 with a specific configuration as shown in FIG. 4A.

Firstly, a bulge 8 having a desired height of projection is formed on the underside of the leg 7 at its free end in order to urge the lid plate 2 against the top wall 12 when it is in its closed position. When the lid plate 2 is in its closed position, the bulge 8 lifts the end of the hinge base 6 adjacent to the hinge 5, and the elasticity of the hinge base 6 so lifted exerts a force on the lid plate 2 urging it against the upper surface 13 of the top wall 12. Such a force also serves to urge the stopper 3 into the opening 14, thereby ensuring the closure of the opening 14. The bulge 8 does not add anything to the force which is required for opening or closing the lid plate 2, but the lid plate 2 can be opened or closed with an amount of force which is identical to that required by the embodiment shown in FIGS. 1 to 3.

Figure 4B:
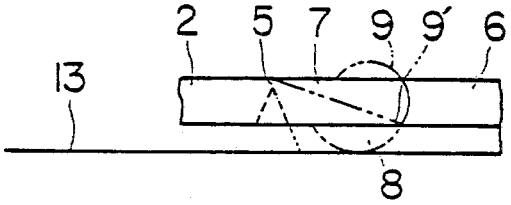

The angle of opening of the lid plate 2 can be enlarged by providing a bulge 9 having a desired height of projection on the upper side of the leg 7 at its free end as shown in FIG. 4B. The hinge base 6 remains elastically deformed until the lid plate 2 completes additional rotation about the leg 7 by an angle corresponding to the height of the bulge 9. In other words, the angle of the lid plate 2 in its open position is increased by an amount which corresponds to the height of the bulge 9. Such a lid, of which the lid plate 2 can be kept wider open, is particularly effective as a lid for a caster.

Figure 5:
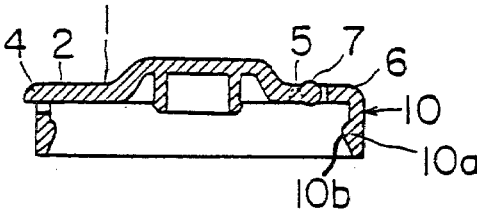
FIG. 5 is a vertical sectional view showing another embodiment of this invention including a pair of bulges formed on the free end of the leg.
Figure 6:
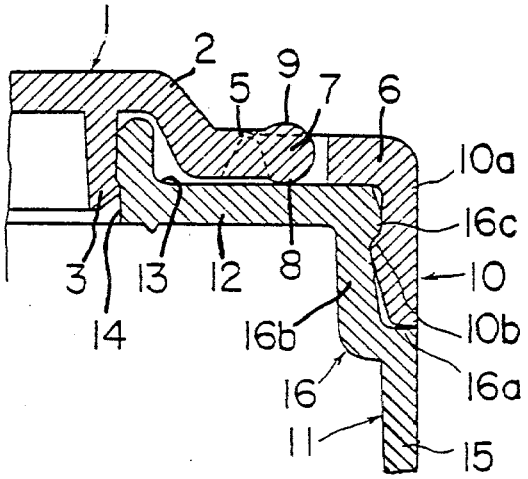
FIG. 6 is a fragmentary enlarged view in the closed position of the lid shown in FIG. 5.
Figure 7:
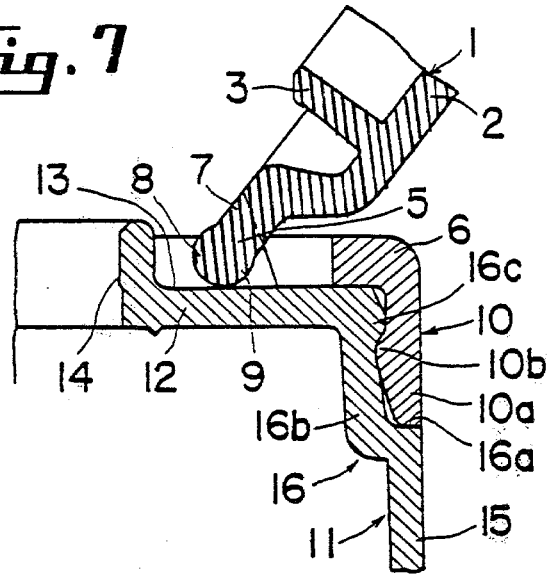
FIG. 7 is a fragmentary enlarged view in the open position of the lid shown in FIG. 5.

A lid having both of the bulges 8 and 9 can hold itself in its closed position automatically, and can maintain a wider angle of opening when it is opened. FIGS. 5 to 7 show such a lid by way of example.

When the lid plate 2 is in its closed position, the hinge base 6 is elastically deformed as its end is slightly raised by the bulge 8 as shown in FIG. 6, and exerts on the lid plate 2 a force having a fulcrum at the bulge 8, a point of force at the hinge 5 and a point of action at the stopper 3, whereby the stopper 3 is urged into the opening 14. When the lid plate 2 is in its open position, the bulge 9 keeps it at a wider angle of opening as shown in FIG. 7.

Finally, the angle of opening of the lid plate 2 can be reduced by cutting off an upper portion 9' of the leg 7 in a pattern downwardly inclined from the hinge 5 to the free end of the leg 7 as shown in FIG. 4B. It is advantageous to provide the bulge 8, in addition to cutting off the upper portion of the leg, and lower the level of the rear half of the upper surface 13 facing the leg 7 by a height corresponding to the projection of the bulge 8, as shown in FIG. 4B.

Figure 8:
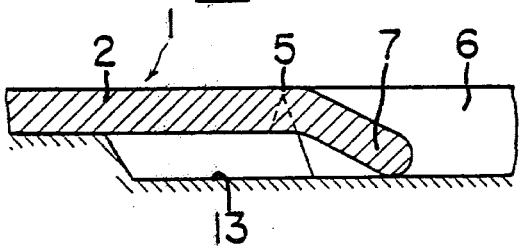
FIG. 8 is a fragmentary enlarged vertical sectional view showing a rearwardly and downwardly inclined leg in the closed position of a lid.
Figure 9:
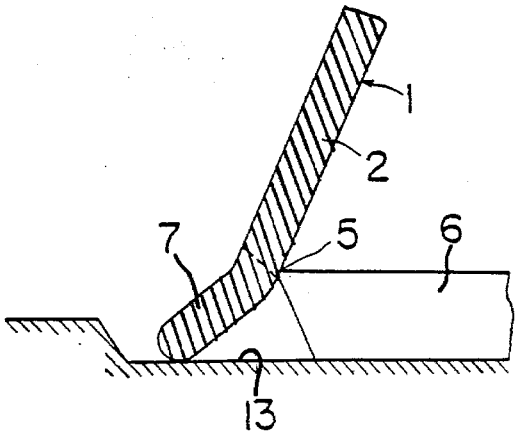
FIG. 9 is a view showing the leg of FIG. 8 in the open position.

The removal of the upper portion 9' from the leg 7 and the provision of the bulge 8 as now described define a structure which is substantially identical to what is realized by a rearwardly and downwardly inclined leg 7 as shown in FIGS. 8 and 9, of which description will now be made.

Even if the bulge 8 is provided, it does not work at all, since the upper surface 13 facing the leg 7 is downwardly displaced by a height corresponding to the projection of the bulge 8. Therefore, the lid plate 2 in its closed position shown in FIG. 8 is exactly in the same position as has been shown for the basic structure already described. When the lid plate 2 is already described. When the lid plate 2 is rotated toward its open position, the hinge base 6 restores its original shape after elastic deformation earlier by an angle corresponding to the reduced height of the upper portion 9', as shown in FIG. 9, so that the lid plate 2 may be kept open after a smaller angle of rotation.

In the lid according to this invention, therefore, the provision of the bulges 8 and 9 on the leg 7 and the removal of the upper portion 9' from the leg 7 render the lid plate 2 capable of holding its closed position, and staying open at a desired angle.

As is obvious from the foregoing description of the hinge base 6 and the leg 7 which cooperate to open or close the lid plate 2 and maintain it in its open or closed position, it is necessary for the hinge base 6 to be secured to the lid base 11 rigidly and with high stability in order to ensure stability in the rotation of the lid plate 2 when it is opened or closed. The secure connection of the hinge base 6 to the lid base 11 is accomplished by the connector 10 depending from the hinge base 6, and a mating connector 16 formed on the lid base 11. Various arrangements are possible for the mating connectors 10 and 16, but those which will hereunder be described are desirable from the standpoints of manufacture, connection and performance.

Figure 10:
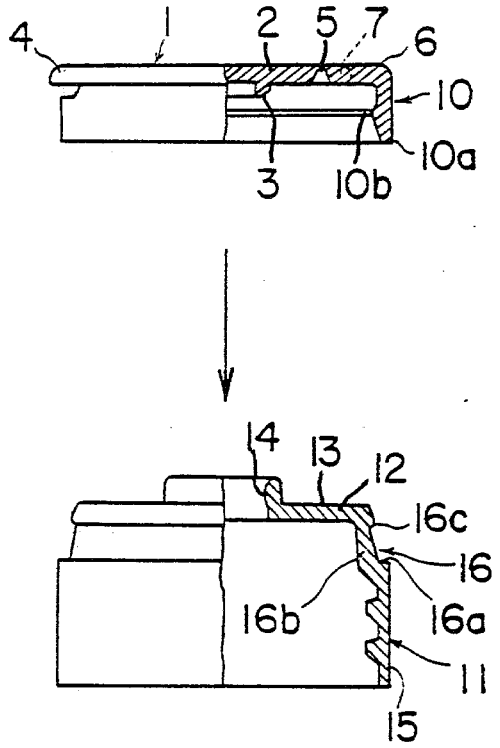
FIG. 10 is a view showing partly in vertical section a structure for connection between a lid and the neck os a container.
Figure 11:
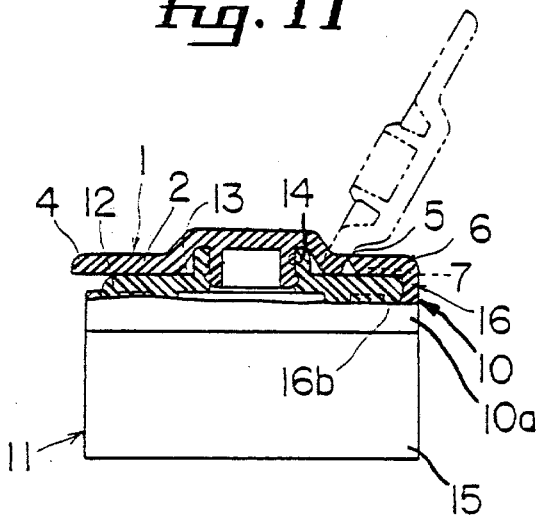
FIG. 11 is a view, partly broken away, showing a modified form of the structure shown in FIG. 10.

Referring first to FIG. 10, the connector 16 on the lid base 11 comprises a generally cylindrical fitting groove **16*b* defined by a shoulder 16*a* at the upper end of the cylindrical connector 15 on the outer surface thereof, and a locking shoulder 16*c* defining the upper end of the fitting groove 16*b*. The connector 10 on the hinge base 6 comprises a fitting ring 10*a* depending from the rear end of the hinge base 6 and adapted to fit closely in the fitting groove 16*b* on the lid base 11, and a locking shoulder 10*b* formed on the inner surface of the fitting ring 10*a*, and facing upward to engage firmly with the downwardly facing locking shoulder 16*c* on the lid base 11. According to the structure shown in FIG. 10, the connector 10 which is integral with the hinge base 6 is joined with the connector 16 on the lid base 11 over an enlarged surface area, so that stable retention of the hinge base 6 can be most certainly ensured. A modified form of the structure shown in FIG. 10 is shown in FIG. 11**.

Figure 12:
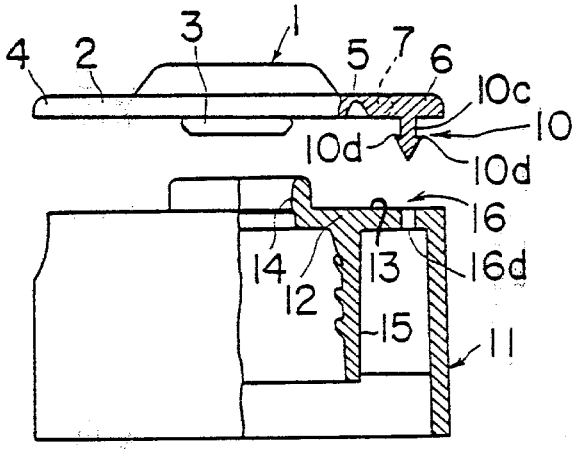
FIG. 12 is a view showing partly in vertical section another embodiment of the structure for connection between a lid and the neck of a container.
Figure 13:
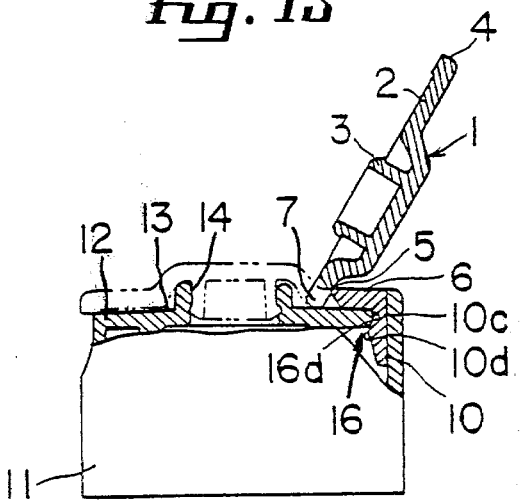
FIG. 13 is a view, partly broken away, showing A modified form of the structure shown in FIG. 12.

Referring secondly to FIG. 12, the connector 10 shown therein comprises a depending member **10*c* projecting downwardly from the underside of the hinge base 6 and having a length which is equal to the thickness of the top wall 12. The depending member 10*c* is formed at its lower end with a laterally extending locking projection 10*d*. The connector 16 on the lid base 11 is defined by a hole 16*d* provided through the top wall 12 and in which the depending member 10*c* is nearly tightly fitted. While the structure shown in FIG. 12 is simpler in construction and easier to handle than that of FIG. 10, the hinge base 6 cannot be held so firmly as its counterpart in FIG. 10. Therefore, it is desirable to render the depending member 10*c* capable of elastic deformation with the hinge base 6, so that such elastic deformation may provide a supplementary force for holding the hinge base 6 in position. A modified form of the structure shown in FIG. 12 shown in FIG. 13. As the connector 16 in the structure shown in FIG. 12 or 13 is defined by the hole 16*d* provided in the top wall 12, it is desirable to employ for the lid base 11 a double cylindrical wall structure having an inner cylindrical wall defining the cylindrical connector 15 and an outer cylindrical wall, and provide the hole 16*d* in that portion of the top wall 12** which is located between the inner and outer walls.

Figure 14:
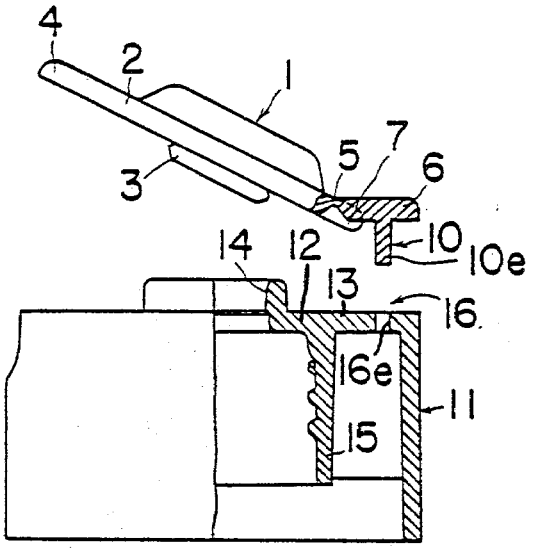
FIG. 14 is an exploded view showing partly in vertical section still another embodiment of the structure for connection between a lid and the neck of a container.
Figure 15:
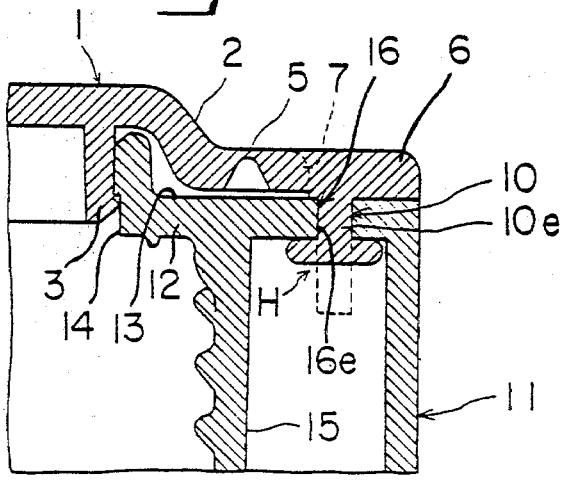
FIG. 15 is a fragmentary enlarged view showing the structure of FIG. 14 in the connected position.
Figure 16:
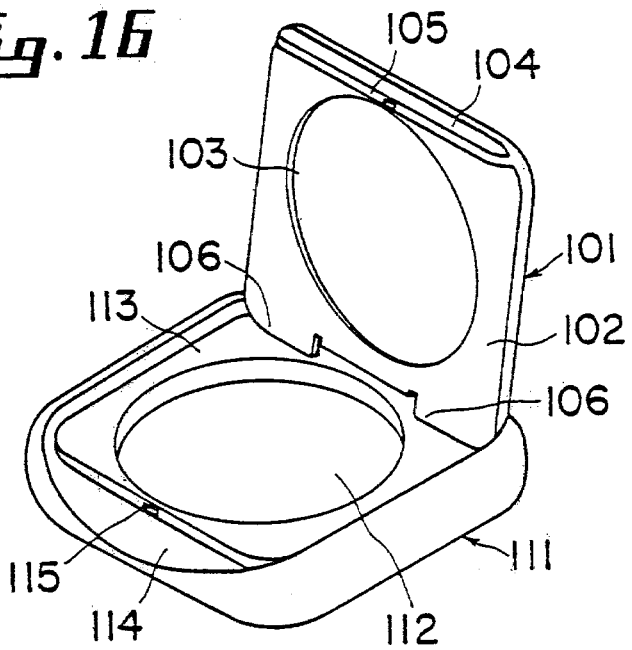
FIG. 16 is a perspective view of a compact embodying this invention in its open position.
Figure 17:
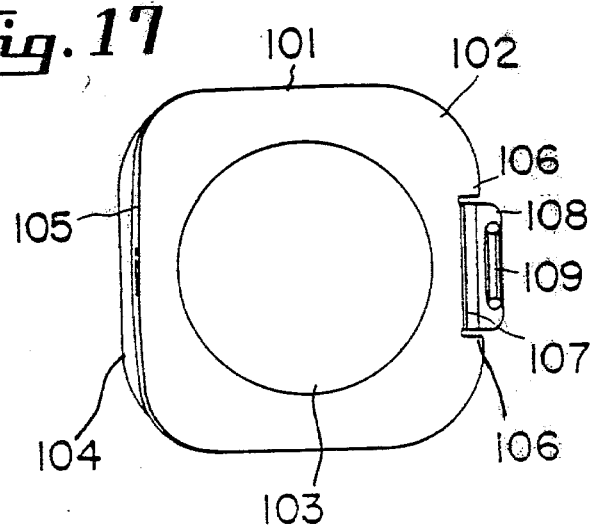
FIG. 17 is a bottom plan view of the lid shown in FIG. 16.
Figure 18:
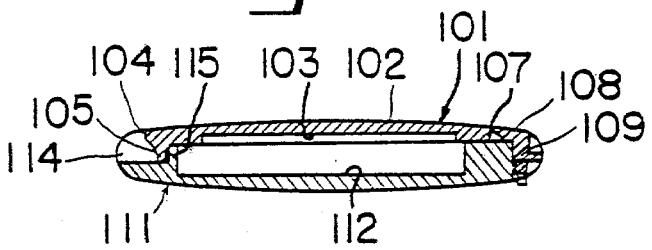
FIG. 18 is a vertical sectional view of the compact in its closed position.
Figure 19:
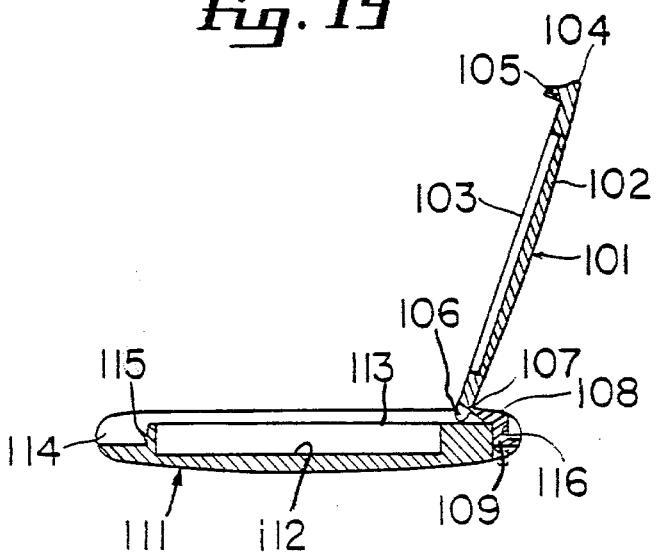
FIG. 19 is a vertical sectional view of the compact in its open position.
Figure 20:
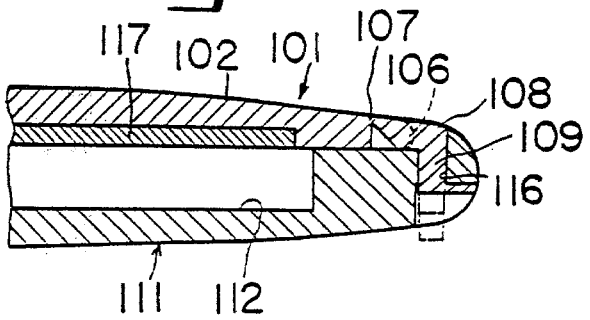
FIG. 20 is a fragmentary enlarged vertical sectional view of the compact in its closed position.

A third preferred connector arrangement is shown in FIGS. 14 and 15. The connector 10 comprises a depending member **10*e* projecting downwardly from the underside of the hinge base 6 and having a length which is sufficiently greater than the thickness of the top wall 12. The connector 16 is defined by a hole 16*e* provided through the top wall 12. The depending member 10*e* extends through the hole 16*e*, and has a lower end projecting downwardly from the hole 16*e*, and flattened by heating as shown at H, whereby the hinge base 6 is connected to the lid base 11. Although the structure shown in FIGS. 14 and 15 provides a very satisfactory support for the hinge base 6 as opposed to that of FIG. 12, it disadvantageously requires one additional step of manufacturing operation, i.e., flattening by heating as at H. As is the case with the arrangement shown in FIG. 12, it is desirable to employ a double cylindrical wall structure for the lid base 11 shown in FIGS. 14 and 15, and provide the hole 16*e* in that portion of the top wall 12 which is located between an inner wall defining the cylindrical connector 15** and an outer wall.

As is evident from the foregoing description, the lid of this invention comprises the lid body 1 and the lid base 11 which are formed separately and connected with each other, but the lid body 1 and the lid base 11 do not necessarily need to be formed from the same synthetic resin. If the whole is integrally formed from one and the same resinous material, there is every likelihood that the hinge 5 may lack the necessary mechanical strength, and polypropylene is presently considered to be the optimum material from which the lid body 1 may be molded. On the other hand, the lid base 11, which is not required to undergo elastic deformation in any part thereof in particular, may be formed from any appropriate synthetic resin that is easy to mold, inexpensive and provides a fine appearance.

It will be understood from the foregoing description that this invention produces a lot of excellent results from the standpoints of manufacture, assembly and use. The lid according to this invention is simple in construction, easy to manufacture and assemble, and useful for a very wide range of applications, as the lid plate 2 can easily be maintained in its open position which can be varied as desired, and can also be held firmly in its closed position.

Attention is now directed to FIGS. 16 to 22 showing compacts or cosmetic cases embodying this invention.

The compact to which this invention is applied as shown by way of example in the drawings is one which is generally used. It comprises a container 111 having a concavity 112 for receiving a drum holding face powder, and a lid 101 having a rear edge connected to the upper surface 113 of the container 111 at the rear edge thereof. The lid 101 is swingable about the rear edge thereof, and comprises a main body 102 having an inner surface formed centrally with a concavity 103 in which a mirror 117 is secured. The container 111 is formed at its front edge with a recess 114 defining a locking member 115 which is engageable with a locking member 105 formed integrally with a finger lip 104 on the front edge of the lid body 102, so that the lid 101 can be held in its closed position.

The lid body 102 has a generally flat rear edge portion reduced in thickness to define a hinge 107 (in the embodiment shown in the drawings, in the mid-portion of the rear edge of the lid body 102), and a hinge base 108 integrally connected therewith. The hinge base 108 has a flat bottom surface from which a fitting member 109 having a desired length depends. A pair of legs 106 having a desired length extend rearwardly from the rear edge of the lid body 102 on either side of the hinge 107. The upper surface 113 of the container 111 on which the lid 101 is adapted to rest is flat at least in a rear end portion thereof in which a hole 116 is provided for receiving the fitting member 109 therein. The connection of the lid 101 with the container 111 is accomplished by firm engagement of the fitting member 109 into the hole 116.

As will become apparent from the following description relating to the opening and closing of the lid 101, a considerably strong force acts on the area in which the lid 101 is connected to the container 111, when the lid 101 is opened. In order to provide a rigid and stable support for the lid 101 relative to the container 111, therefore, it is desirable that the free end of the fitting member 109 projecting from the hole 116 be secured by flattening under heat as shown, instead of being simply fitted in the hole 116. Besides such flattening, it is possible to resort to other means such as providing an undercut, or an additional securing member, and any such means is acceptable if it serves to secure the hinge base 108 to the rear end of the upper surface 113 of the container 111 without causing any shaky movement of the hinge base 108.

When a finger is engaged with the finger lip 104 to apply a force required for disengaging the locking members 105 and 115 in order to open the lid 101 from its closed position maintained by the mutual engagement of the locking members 105 and 115, the lid body 102 is caused to rotate about the hinge 107, and the rear ends of the legs 106 disposed rearwardly of the hinge 107 are pressed against the flat upper surface 113 of the container 111. If the lid 101 is further rotated, the legs 106, of which the rear or free ends remain pressed against the upper surface 113, cause displacement of the hinge 107 away from the upper surface 113, and elastic deformation of the hinge base 108 in such a manner that its edge contiguous to the hinge 107 is upwardly displaced. The elastic deformation of the hinge base 108 reaches its maximum degree when the lid 101 is perpendicular to the upper surface 113 as shown in FIG. 21.

Figure 21:
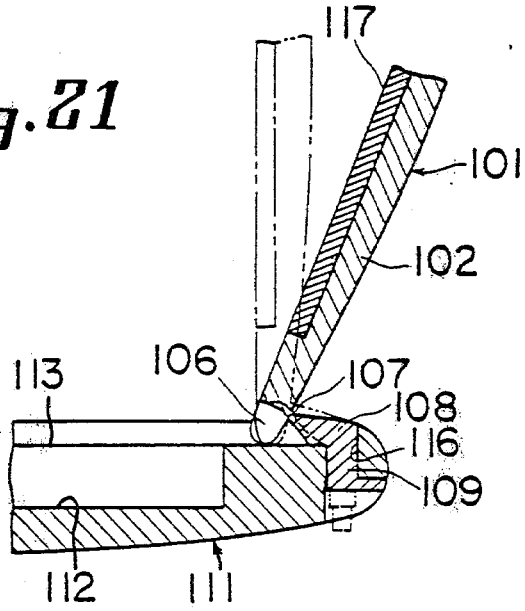
FIG. 21 is a fragmentary enlarged vertical sectional view of the compact in its open position.

With further rotation of the lid 101 after it has become perpendicular to the upper surface 113, the hinge base 108 begins to restore its original shape after its maximum elastic deformation, and when the lid 101 has been rotated into its open position shown by solid lines in FIG. 21 as determined by the length of extension of the legs 106 shown by solid lines, i.e., the distance between the hinge 107 and the free ends of the legs 106, and the height of the hinge 107 above the upper surface 113, the hinge base 108 restores its original position shown by solid lines in FIG. 21.

In its position shown by solid lines in FIG. 21, the lid 101 is urged toward its closed position by the elasticity of the hinge 107, but its rotation toward the closed position is hindered by the hinge base 108. Therefore, the lid 101 is maintained at an angle of rotation shown by the solid lines in FIG. 21 as determined by the length of extension of the legs 106 and the height of the hinge 107 above the upper surface 113.

Therefore, if the length of extension of the legs 106 and the height of the hinge 107 above the upper surface 113 are properly selected, the angle of opening of the lid 101 as shown by the solid lines in FIG. 21 can be set where the mirror 117 can be conveniently used, so that when the lid 101 is opened, it may automatically stop at an angle of opening which permits convenient use of the mirror 117.

In order to close the lid 101, it is sufficient to rotate it in the direction which closes it as is the case with any known compact. According to this invention, if the lid 101 is rotated in the closing direction slightly past its position shown by broken lines in FIG. 21, the rest of the closing operation is automatically by the elasticity of the hinge base 108 with a force which permits automatic engagement of the locking member 105 with the locking member 115 to thereby close the compact.

Thus, the compact according to this invention can be very conveniently used, as the cooperation of the legs 106, the hinge 107 and the hinge base 108 accomplishes automatic positioning of the lid 101 at a preselected angle of opening, and automatic closure of the lid 101 with the mutual engagement of the locking members 105 and 115. As the connection of the lid 101 with the container 111 is achieved simply by the fitting member 109 and the hole 116, there is no possibility that any dimensional error in the molding of the associated parts may cause a serious problem, but a wide range of dimensional tolerances is permissible for such parts.

If the whole lid 101, including the hinge 107, is formed as an integral piece, it is desirable to mold it from polypropylene in order to maintain proper strength of the hinge 107.

Figure 22:
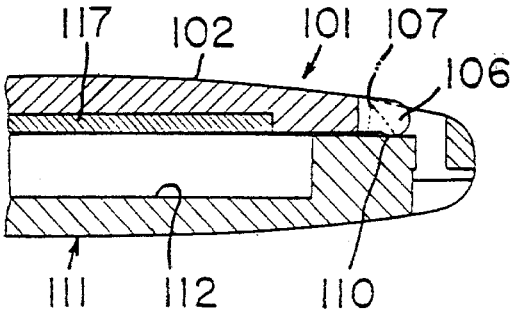
FIG. 22 is a fragmentary enlarged vertical sectional view, taken along an irregular line, of another form of the compact embodying this invention in its closed position.

While in the embodiment hereinabove described, the mutual engagement of the locking members 105 and 115 maintains the lid 101 in its closed position, another embodiment of the compact shown in FIG. 22 includes a bulge 110 protruding downwardly from the free end of each leg 106. When the lid 101 is in its closed position, the bulges 110, which are integral with the legs 106, press against the upper surface 113 of the container 111, so that the hinge 107 is slightly raised by overcoming the elasticity of the hinge base 108, whereby the free end of the lid 101 is urged against the container 111. This means that the bulges 110 serve to maintain the lid 101 in its closed position. Therefore, if the thickness or amount of projection of the bulges 110 is appropriately selected, it is possible to hold the lid 101 in its closed position without requiring any locking member 105 or 115. By virtue of its excellent sealing effect obtained by the lid 101 pressing against the container 111, the embodiment shown in FIG. 22 provides a particularly useful compact intended for holding an expensive cosmetic containing a perfume which requires storage in a highly sealed container.

It will be understood from the foregoing description that the compact of this invention provides a lot of superior results from the standpoints of use, manufacture and cost, as the lid 101 can be automatically held in its open position convenient for the use of the mirror 117, and automatically brought back to its closed position upon application of a slight amount of rotational impact thereon, and as it is also easy to mold and assemble with a wide range of dimensional tolerances without any necessity of pursuing any particular molding accuracy for those portions of the lid 101 and the container 111 which are connected with each other.

What is claimed is:

1. In a compact made of a synthetic resin comprising a container (111) for a cosmetic, and a lid (101) connected to the upper surface of said container at the rear end thereof, and swingable like a cover for a book to open or close said container, the improvement in which said lid (101) comprises a main body (102), a generally flat rear end portion of said main body reduced in thickness to define a hinge (107), a hinge base (108) contiguous to said hinge, a fitting member (109) depending from the underside of said hinge base (108), and a leg (106) of desired length extending rearwardly from the rear end of said main body (102), said leg being discontinuous in the area of said hinge, while said container (111) comprises said upper surface (113) which is flat at least in the rear end portion thereof where said lid (101) is connected to said container, and a hole (116) provided in said rear end portion thereof opposite to said fitting member (109) of said lid (101) for receiving said fitting member (109) therein to hold it against any shaky movement.

2. A compact made of a synthetic resin comprising a container (111) for a cosmetic, and a lid (101) connected to the upper surface of said container at the rear end thereof, and swingable like a cover for a book to open or close said container, the improvement in which said lid (101) comprises a main body (102), a generally flat rear end portion of said main body reduced in thickness to define a hinge (107), a hinge base (108) contiguous to said hinge, a fitting member (109) depending from the underside of said hinge base (108), a leg (106) of desired length extending rearwardly from the rear end of said main body (102), said leg being discontinuous in the area of said hinge, and a bulge (110) depending from the underside of said leg (106) at the free end thereof and having a desired height of projection, while said container (111) comprises said upper surface (113) which is flat at least in the rear end portion thereof where said lid (101) is connected to said container, and a hole (116) provided in said rear end portion thereof opposite to said fitting member (109) of said lid (101) for receiving said fitting member (109) therein to hold it against any shaky movement.

3. A compact as set forth in claim 1 or 2, wherein said fitting member (109) has a lower end projecting from said hole (116) and flattened under heat, whereby said lid (101) is secured to said container (111).

* * * * *